US005977928A

United States Patent [19]

Ying et al.

[11] Patent Number: 5,977,928

[45] Date of Patent: Nov. 2, 1999

[54] HIGH EFFICIENCY, MULTI-BAND ANTENNA FOR A RADIO COMMUNICATION DEVICE

[75] Inventors: Zhinong Ying, Lund; Anders Dahlström, Vellinge; Thomas Bolin, Lund, all of Sweden

[73] Assignee: Telefonaktiebolaget LM Ericsson, Stockholm, Sweden

[21] Appl. No.: 09/086,619

[22] Filed: May 29, 1998

[51] Int. Cl.[6] ..... H01Q 9/04

[52] U.S. Cl. ..... 343/790; 343/702; 343/905; 455/575; 455/90

[58] Field of Search ..... 343/702, 790, 343/791, 792, 905; 455/575, 90

[56] References Cited

U.S. PATENT DOCUMENTS

| | | | |
|---|---|---|---|
| 4,509,056 | 4/1985 | Ploussios | 343/791 |
| 4,571,595 | 2/1986 | Phillips et al. | 343/745 |
| 4,746,925 | 5/1988 | Torlyama | 343/713 |
| 5,336,896 | 8/1994 | Katz | 250/515.1 |
| 5,440,317 | 8/1995 | Jalloul et al. | 343/791 |
| 5,535,435 | 7/1996 | Balzano et al. | 455/89 |
| 5,541,609 | 7/1996 | Stutzman et al. | 343/702 |
| 5,572,224 | 11/1996 | Moller et al. | 343/702 |
| 5,691,730 | 11/1997 | Egashira et al. | 343/702 |
| 5,719,587 | 2/1998 | Rodal | 343/791 |
| 5,828,342 | 10/1998 | Hayes et al. | 343/702 |

FOREIGN PATENT DOCUMENTS

| | | | |
|---|---|---|---|
| 0 508299 | 4/1992 | European Pat. Off. | H01Q 1/24 |
| 0 635 898 | 1/1995 | European Pat. Off. | H01Q 1/27 |
| 0 675 562 | 10/1995 | European Pat. Off. | H01Q 1/24 |
| 63-7531 | 1/1988 | Japan | G11B 7/24 |
| 6-37542 | 2/1994 | Japan | H01Q 21/28 |
| 7-326920 | 12/1995 | Japan | H01Q 9/18 |
| 9-74304 | 3/1997 | Japan | H01Q 1/24 |
| 97/12417 | 4/1997 | WIPO | H01Q 9/30 |
| WO9713290 | 4/1997 | WIPO | H01Q 1/24 |
| 97/49141 | 12/1997 | WIPO | H01Q 1/36 |
| 98/15028 | 4/1998 | WIPO | H01Q 1/36 |

*Primary Examiner*—Don Wong
*Assistant Examiner*—Shih-Chao Chen
*Attorney, Agent, or Firm*—Burns, Doane, Swecker & Mathis, L.L.P.

[57] ABSTRACT

The present invention provides a radio communication device having a multi-band swivel antenna assembly. The antenna assembly includes a multi-band radiating antenna element and a multi-band sleeve which allows the antenna to be tuned to multiple resonances. The multi-band antenna element and sleeve are attached to the chassis of the communication device via a coaxial feeding cable which serves to isolate those elements from the chassis.

35 Claims, 8 Drawing Sheets h ≃ 2 cm

H ≃ 12 cm

Radiation patterns at 1800 MHz

New antenna in talking position (45 °)

Tested frequency: 1800 MHz

Measured gain:
* Max: -36.7 dB
* Min: -58.5 dB
* Mean: -41.5 dB

Stub antenna in talking position (45 °)

Tested frequency: 1800 MHz

Measured gain:
* Max: -40.9 dB
* Min: -71.3 dB
* Mean: -45.6 dB

Radiation patterns at 900 MHz

New antenna in talking position (45°)

Tested frequency: 900 MHz

Measured gain:
* Max: -26.7 dB
* Min: -61.5 dB
* Mean: -30.2 dB

Stub antenna in talking position (45°)

Tested frequency: 900 MHz

Measured gain:
* Max: -28.6 dB
* Min: -61.3 dB
* Mean: -33.3 dB

HIGH EFFICIENCY, MULTI-BAND ANTENNA FOR A RADIO COMMUNICATION DEVICE

BACKGROUND

The present invention relates generally to radio communication systems and, in particular, to antennas which can be incorporated into portable terminals and which allow the portable terminals to communicate within different frequency bands while simultaneously increasing antenna efficiency.

The cellular telephone industry has made phenomenal strides in commercial operations in the United States as well as the rest of the world. Growth in major metropolitan areas has far exceeded expectations and is rapidly outstripping system capacity. If this trend continues, the effects of this industry's growth will soon reach even the smallest markets. Innovative solutions are required to meet these increasing capacity needs as well as maintain high quality service and avoid rising prices.

Throughout the world, one important step in the advancement of radio communication systems is the change from analog to digital transmission. Equally significant is the choice of an effective digital transmission scheme for implementing the next generation technology, e.g., time division multiple access (TDMA) or code division multiple access (CDMA). Furthermore, it is widely believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

To provide an acceptable level of equipment compatibility, standards have been created in various regions of the world. For example, analog standards such as AMPS (Advanced Mobile Phone System), NMT (Nordic Mobile Telephone) and ETACS and digital standards such as D-AMPS (e.g., as specified in EIA/TIA-IS-54-B and IS-136) and GSM (Global System for Mobile Communications adopted by ETSI) have been promulgated to standardize design criteria for radio communication systems. Once created, these standards tend to be reused in the same or similar form, to specify additional systems. For example, in addition to the original GSM system, there also exists the DCS1800 (specified by ETSI) and PCS1900 (specified by JTC in J-STD-007), both of which are based on GSM.

However, the most recent evolution in cellular communication services involves the adoption of additional frequency bands for use in handling mobile communications, e.g., for Personal Communication Services (PCS) services. Taking the U.S. as an example, the Cellular hyperband is assigned two frequency bands (commonly referred to as the A frequency band and the B frequency band) for carrying and controlling communications in the 800 MHz region. The PCS hyperband, on the other hand, is specified in the United States to include six different frequency bands (A, B, C, D, E and F) in the 1900 MHz region. Thus, eight frequency bands are now available in any given service area of the U.S. to facilitate communication services. Certain standards have been approved for the PCS hyperband (e.g., PCS1900 (J-STD-007), CDMA (IS95) and D-AMPS (IS-136)), while others have been approved for the Cellular hyperband (e.g., AMPS (IS-54)).

Each one of the frequency bands specified for the Cellular and PCS hyperbands is allocated a plurality of traffic channels and at least one access or control channel. The control channel is used to control or supervise the operation of mobile stations by means of information transmitted to and received from the mobile stations. Such information may include incoming call signals, outgoing call signals, page signals, page response signals, location registration signals, voice channel assignments, maintenance instructions, handoff, and cell selection or reselection instructions as a mobile station travels out of the radio coverage of one cell and into the radio coverage of another cell. The control or voice channels may operate in either an analog mode, a digital mode, or a combination mode.

The signals transmitted by a base station in the downlink over the traffic and control channels are received by mobile or portable terminals, each of which have at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna. As seen in FIG. 1, a helical antenna allows the design to be shorter by coiling the antenna along its length.

In order to avoid losses attributable to reflections, antennas are typically tuned to their desired operating frequency. Tuning of an antenna refers to matching the impedance seen by an antenna at its input terminals such that the input impedance is seen to be purely resistive, i.e., it will have no appreciable reactive component. Tuning can, for example, be performed by measuring or estimating the input impedance associated with an antenna and providing an appropriate impedance matching circuit.

As described above, it will soon be commercially desirable to offer portable terminals which are capable of operating in widely different frequency bands, e.g., bands located in the 900 MHz region and bands located in the 1800 MHz region. Accordingly, antennas which provide adequate gain and bandwidth in both frequency bands will need to be employed in portable terminals in the near future. Several attempts have been made to create such dual-band antennas.

For example, U.S. Pat. No. 4,571,595 to Phillips et al. describes a dual-band antenna having a sawtooth shaped conductor element. The dual-band antenna can be tuned to either of two closely spaced apart frequency bands (e.g, centered at 915 MHz and 960 MHz). This antenna design is, however, relatively inefficient since it is so physically close to the chassis of the mobile phone.

Japanese patent no. 6-37531 discloses a helix which contains an inner parasitic metal rod. In this patent, the antenna can be tuned to dual resonant frequencies by adjusting the position of the metal rod. Unfortunately, the bandwidth for this design is too narrow for use in cellular communications.

Dual-band, printed, monopole antennas are known in which dual resonance is achieve by the addition of a parasitic strip in close proximity to a printed monopole antenna. While such an antenna has enough bandwidth for cellular communications, it requires the addition of a parasitic strip. Moteco AB in Sweden has designed a coil matching dual-band whip antenna and coil antenna, in which dual resonance is achieved by adjusting the coil matching component (¼ λ A for 900 MHz and ½ λ for 1800 MHz). While this antenna has relatively good bandwidth and radiation performances, its length is only about 40 mm. A non-uniform helical dual-band antenna which is relatively small in size is disclosed in copending, commonly assigned patent application Ser. No. 08/725,507, entitled "Multiple Band Non-Uniform Helical Antennas," the entirety of which is incorporated by reference.

Presently, antennas for radio communication devices, such as mobile phones, are mounted directly on the phone chassis. The close proximity of the antenna to the user's head degrades the performance of the antenna, and ultimately the communication device when the mobile phone is in the talking position. The present invention proposes locating the radiating part of the antenna as far as possible away from the user's head in order to increase radiation efficiency.

SUMMARY

The present invention provides a radio communication device having a multi-band swivel antenna assembly which is designed so as to increase antenna efficiency. Exemplary embodiments of the present invention provide an antenna assembly which includes a multi-band radiating antenna element and a multi-band sleeve. The multi-band radiator and sleeve allow the antenna to be tuned to multiple resonances. The multi-band antenna element and sleeve are attached to the chassis of the communication device via a coaxial feeding cable which serves to isolate those elements from the chassis. When the antenna is placed into a fully deployed position, the distance between the radiating portion of the antenna (i.e., the multi-band radiating antenna element and multi-band sleeve) and the user's head leads to an increase in antenna efficiency. A ferrite coating is also introduced at the bottom of the coaxial cable in order to reduce the current flow to the chassis.

BRIEF DESCRIPTION OF THE DRAWINGS

The above objects and features of the present invention will be more apparent from the following description of the preferred embodiments with reference to the accompanying drawings, wherein:

FIG. 4(*b*) illustrates a side view of the mobile phone with the multi-band swivel antenna in a fully deployed position according to the present invention;

DETAILED DESCRIPTION

Figure 1:
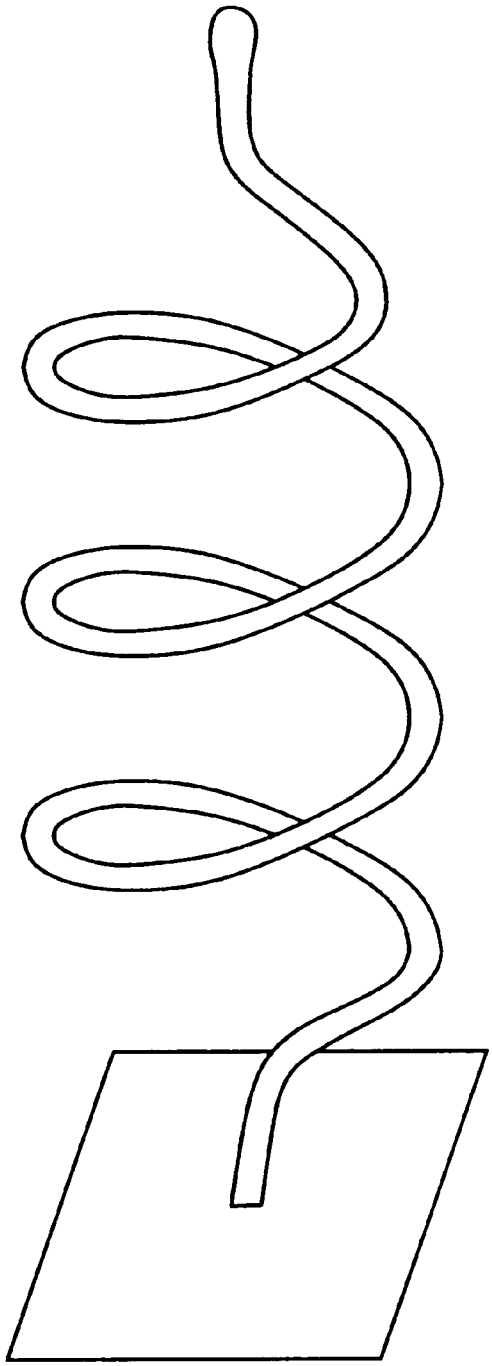
FIG. 1 (PRIOR ART)
FIG. 1 illustrates a conventional helical antenna.
Figure 2:
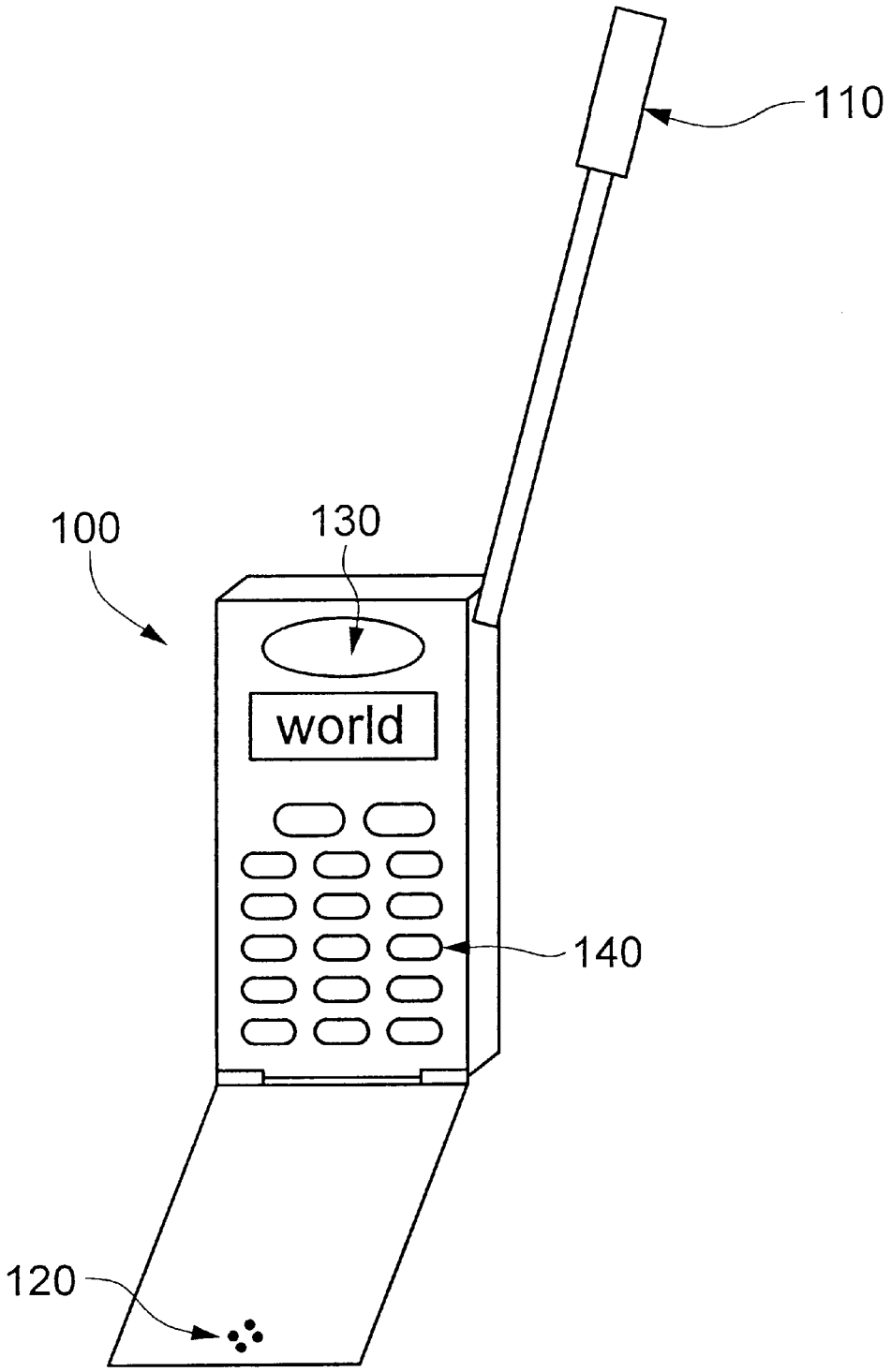
FIG. 2 illustrates an exemplary radio communication device according to the present invention.

FIG. 2 illustrates a radio communication device 100 in accordance with the present invention. Communication device 100 includes an antenna assembly 110 which is attached to the body (or chassis) of the phone. The antenna assembly 110, according to the present invention, is a swivel-type, multi-band antenna, the details of which will be described below. The communication device 100 also includes a microphone opening 120 and speaker opening 130 located approximately next to the position of the mouth and ear, respectively, of a user. The keypad 140 allows the user to interact with the communication device, e.g., by inputting a telephone number to be dialed.

It is recognized in the art that operation of these radio-communication devices in close proximity to a user results in a portion of the RF transmission being absorbed or blocked thereby degrading transmission power. As a result, performance and transmission range suffer.

Figure 3:
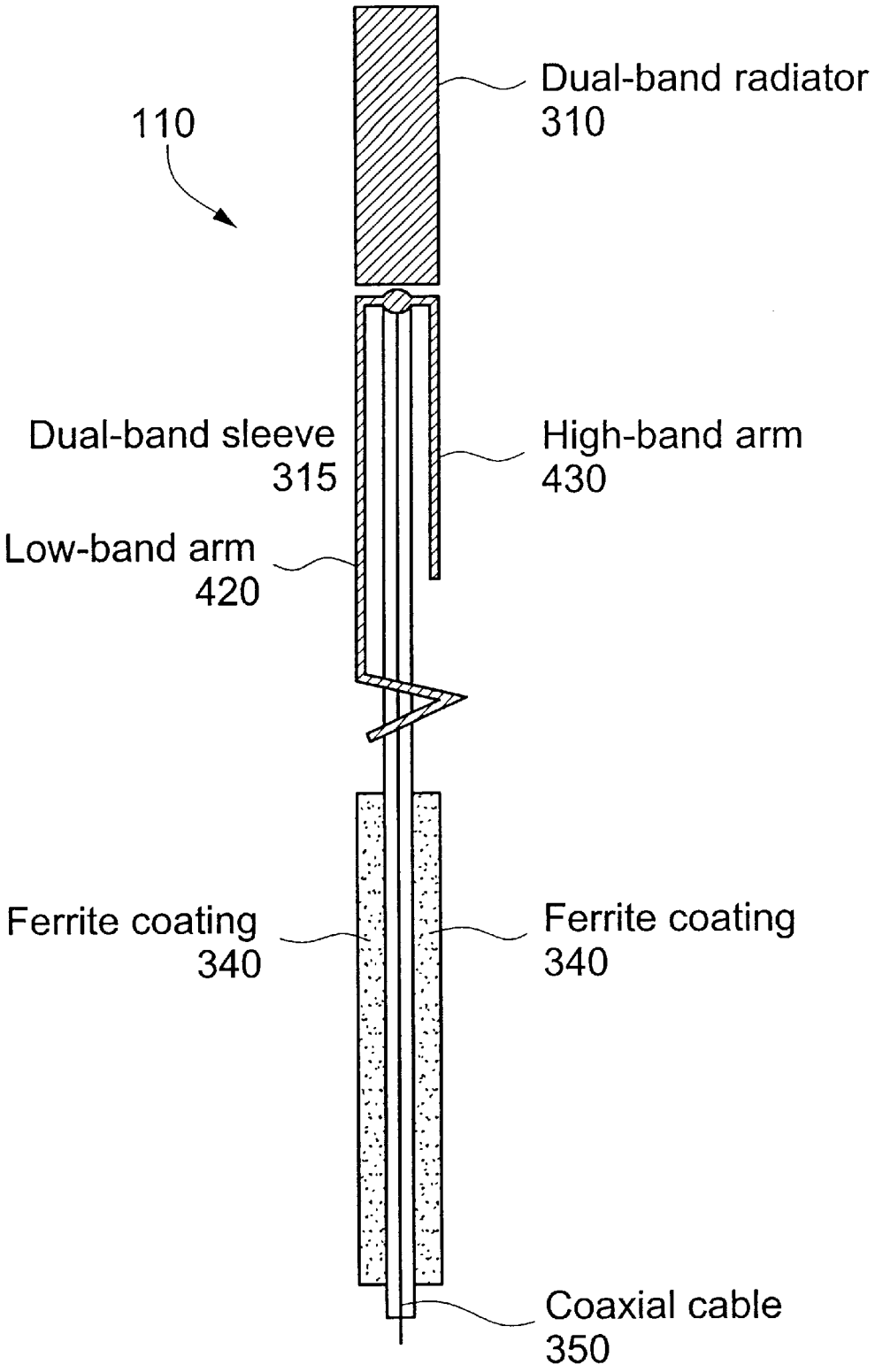
FIG. 3 illustrates a multi-band swivel antenna according to the present invention.

The multi-band swivel antenna of the instant invention attempts to overcome these deficiencies in the art. FIG. 3 illustrates the multi-band swivel antenna 110 according to the present invention. As will be illustrated below, the multi-band swivel antenna is a half-wavelength dipole. As such, one skilled in the art will appreciate that the antenna of the present invention is self-matched (i.e., no external impedance matching components are needed).

Multi-band swivel antenna 110 includes a small dual-band radiating element 310. One type of dual-band radiator is set forth in copending, commonly assigned, patent application Ser. No. 08/958,846, "Multiple Band, Multiple Branch Antenna for Mobile Phone," which is hereby incorporated by reference. The small dual-band radiating antenna element 310 is connected to the chassis of the communication device via an inner conductor of the coaxial feeding cable 350. Since it is non-radiating, a coaxial feeding cable 350 acts to isolate the antenna element 310 from the chassis.

Two conductor arms 420 and 430 are connected at a joint connection point to opposite sides of the outer conductor of the feeding cable 350 near the dual-band antenna element 310. These two arms are of different lengths and together form the dual-band sleeve 315 of the present invention. By controlling the lengths of the conductor arms, the dual-band sleeve 315 is capable of being tuned to different frequencies. Additionally, the gap between the conductor arms and the coaxial cable can be altered in order to increase/decrease bandwidth.

The first arm 420 of the dual-band sleeve 315 is of a length (generally a quarter or half wavelength of the frequency band to which the arm is to be tuned) and construction so as to be resonant at frequencies in a first lower band, and the second arm 430 is of a length and construction so as to be resonant at frequencies in a second higher band. The two arms can be made resonant at any frequency. For example, the first band may be the GSM band and the second band may be the DCS band. As such, the first arm 420 is approximately ¼ wavelength of a GSM signal (i.e., 900 MHz), and the second arm 430 is approximately ¼ wavelength of a DCS signal (i.e., 1800 MHz). This allows the antenna to be easily tuned to dual resonances. While the present example sets forth that the first and second bands are GSM and DCS bands, respectively, one skilled in the art will appreciate that other combinations of frequency bands may be implemented without departing from the spirit and scope of the present invention. For example, other possible combinations of low and high bands could include GSM+PCS, GSM+WCDMA, DCS+WCDMA, GSM+GPS, GSM+ISM, or any other combination of lower and higher frequency bands.

The dual-band sleeve can be manufactured as printed metal strips, a wire structure or etched onto a plastic frame. The end of the longest of the two arms (i.e., the low-band arm 420) can be formed into a meandering shape, as illustrated in FIG. 3. As one skilled in the art will appreciate, the end of the longest arm could alternatively be formed as other shapes, such as a loop or helical shape.

The dual-band radiating antenna element 310 in conjunction with the dual-band sleeve 315 form the radiating portion of Applicants' multi-band swivel antenna. When the antenna is in a fully deployed position, see FIG. 2 for example, this radiating portion would be at a sufficient distance from the user's head to as to reduce the radiation loss due to the human body. Furthermore, little of the radio frequency emission would be blocked by the user's body which would increase the range and overall efficiency of the communication device.

In order to further increase antenna efficiency, a ferrite coating 340 is applied to the feeding cable nearest the end where the cable connects to the chassis. This ferrite coating 340 minimizes the amount of radio frequency currents that returns to the chassis from the radiating portion of the antenna. These currents are unwanted because they are dissipated in the hand and face of the user thereby decreasing the antenna efficiency. Moreover, the dual-band sleeve 315 aids in reducing the current flow down the coaxial cable 350. This is evident from the fact that extremely high impedance (i.e., infinite impedance) exists between the end of the resonant arms 420, 430 and the coaxial cable 350.

Figure 4A:
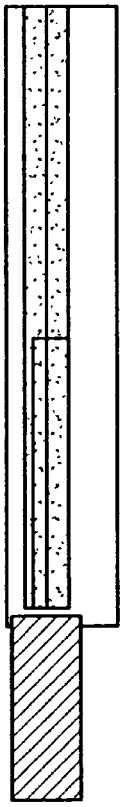
FIG. 4(*a*) illustrates a side view of the mobile phone with the multi-band swivel antenna in a stowed position according to the present invention.
Figure 4B:
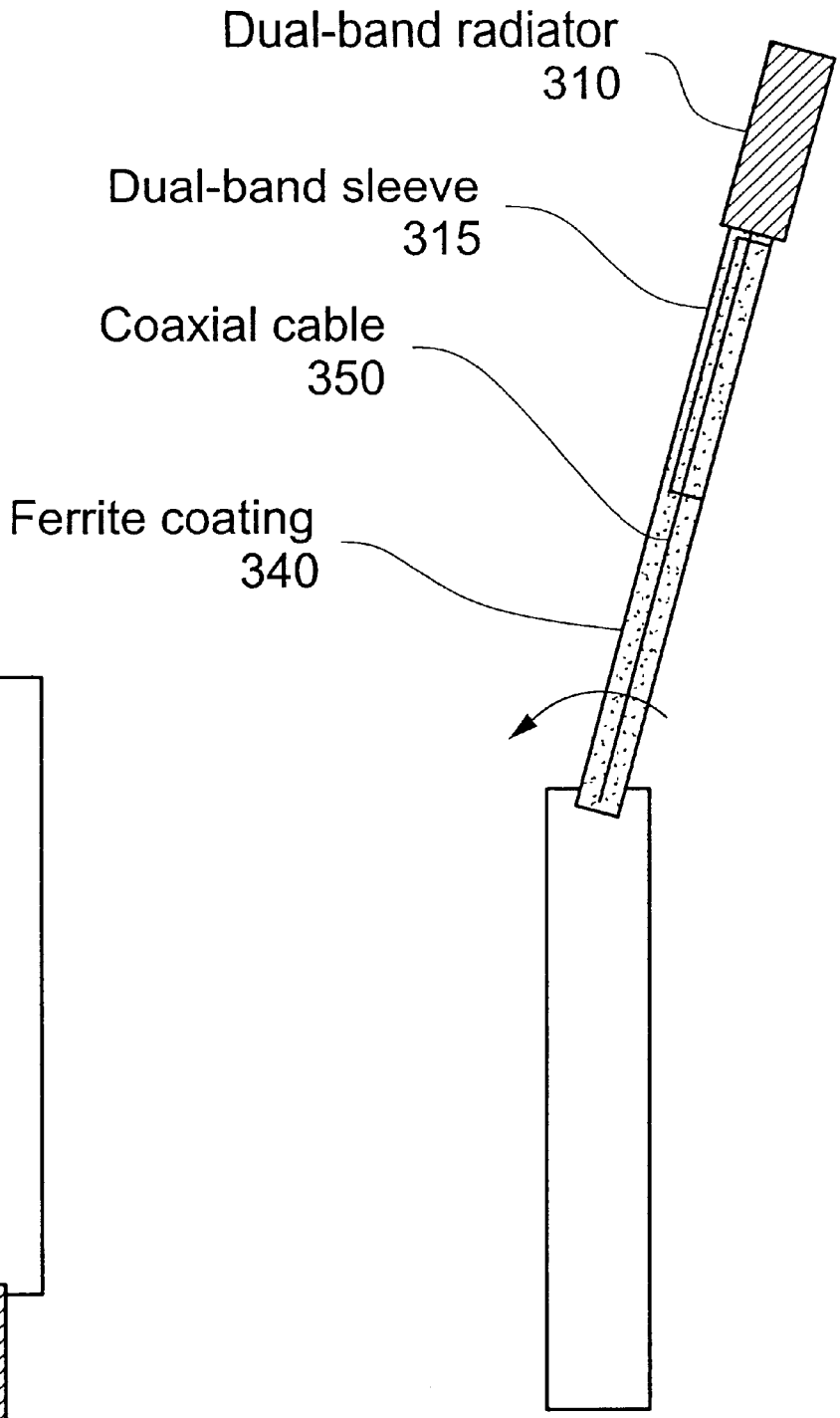

FIGS. 4(*a*) and (*b*) illustrate side views of the radio communication device according to the present invention. In FIG. 4(*a*), the multi-band swivel antenna is displayed in a stowed position. In this position, the communication device is considered to be in a paging mode. When in a talking mode, as is illustrated in FIG. 4(*b*), the antenna may be rotated into a fully deployed position.

Figure 5A:
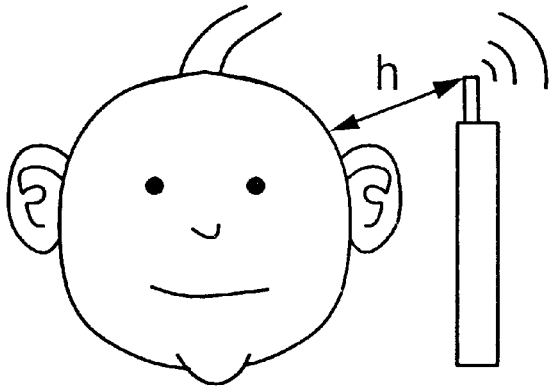
FIG. 5A (PRIOR ART)
FIGS. 5(*a*) and (*b*) illustrate the distance between a user's head and the radiator of a conventional antenna structure and the radiator according to the present invention.
Figure 5B:
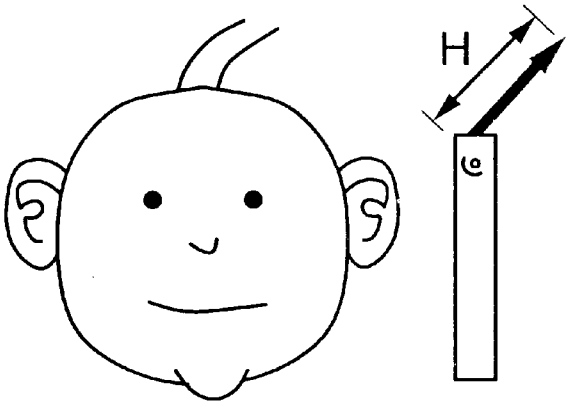

When the radiating part of the swivel antenna is positioned far from the user's head, extremely low RF absorption results. The distance between the radiator and the user's head, according to an exemplary embodiment of the present invention, can be increased 6 to 7 times that of a conventional antenna system. FIGS. 5(*a*) and (*b*) illustrate the proximity of a conventional radiating antenna structure compared to that of the radiator of the present invention. As illustrated in FIGS. 5(*a*) and (*b*), the distance of the radiating portion of a conventional antenna is typically 2 cm from a user's head whereas the distance of the radiator, according to present invention, is approximately 12 cm from the user's head. As will be appreciated by one skilled in the art, the greater distance provided by the present invention would greatly increase antenna efficiency.

Figure 6:
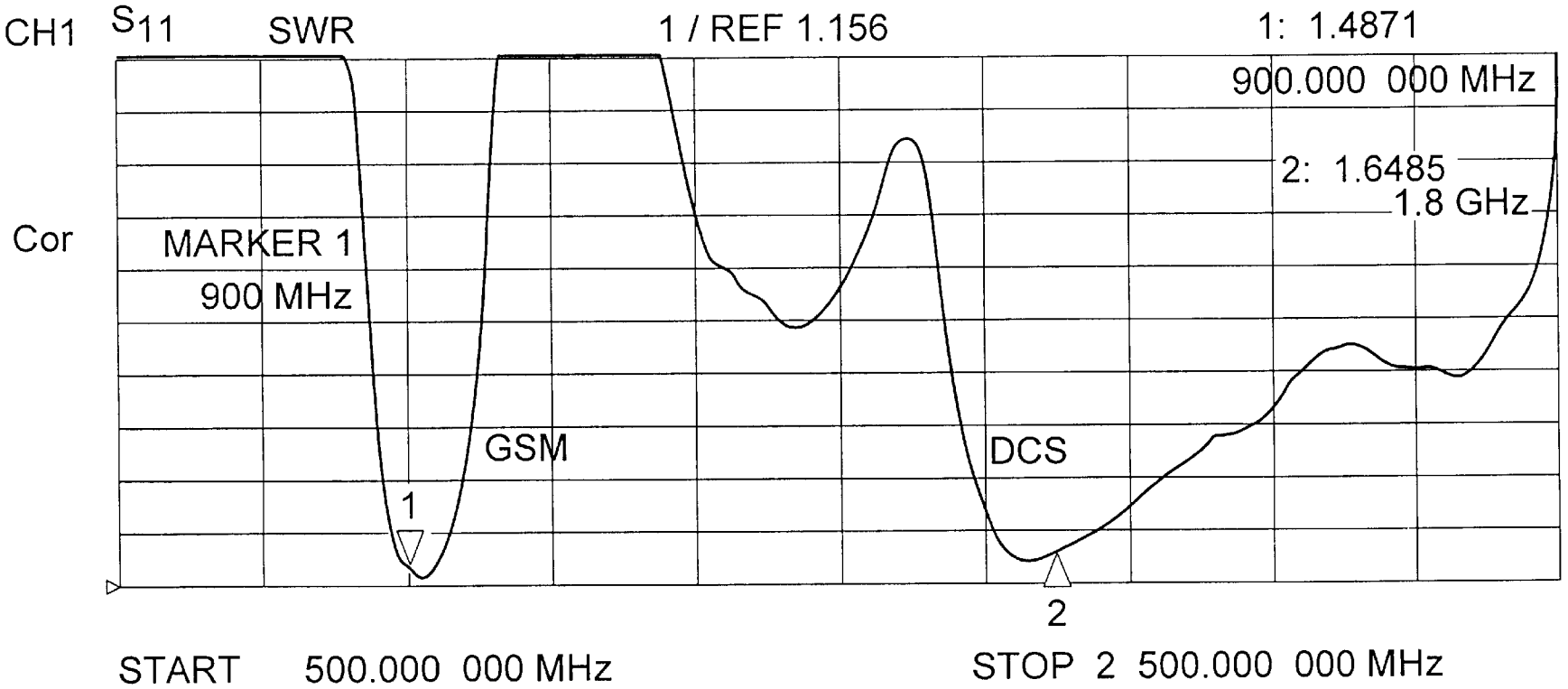
FIG. 6 illustrates a graphical representation of the performance of the multi-band swivel antenna according to the present invention.
Figure 7:
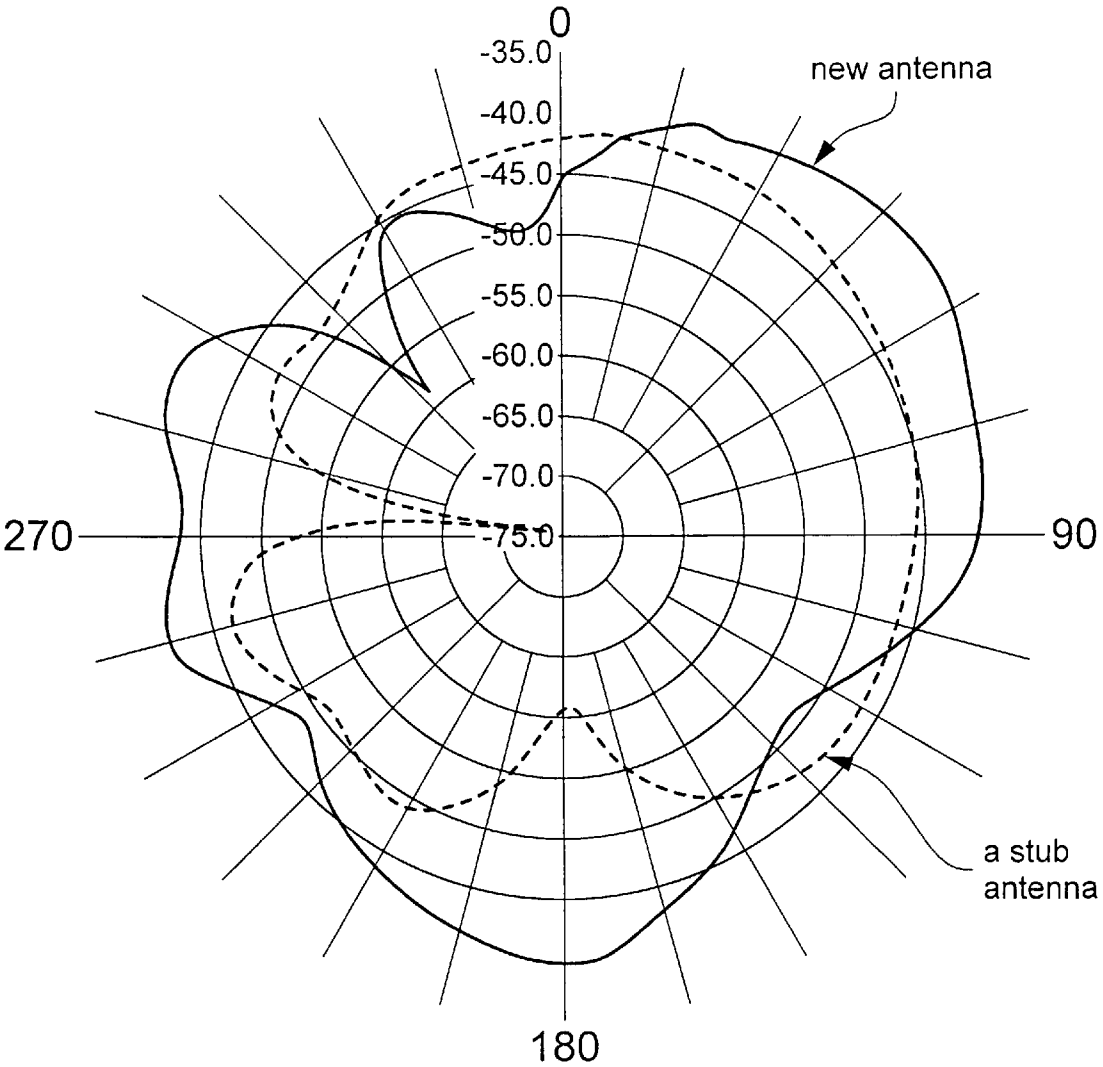
FIG. 7 illustrates the radiation patterns at 1800 MHz for a stub antenna and the multi-band swivel antenna according to the present invention.
Figure 8:
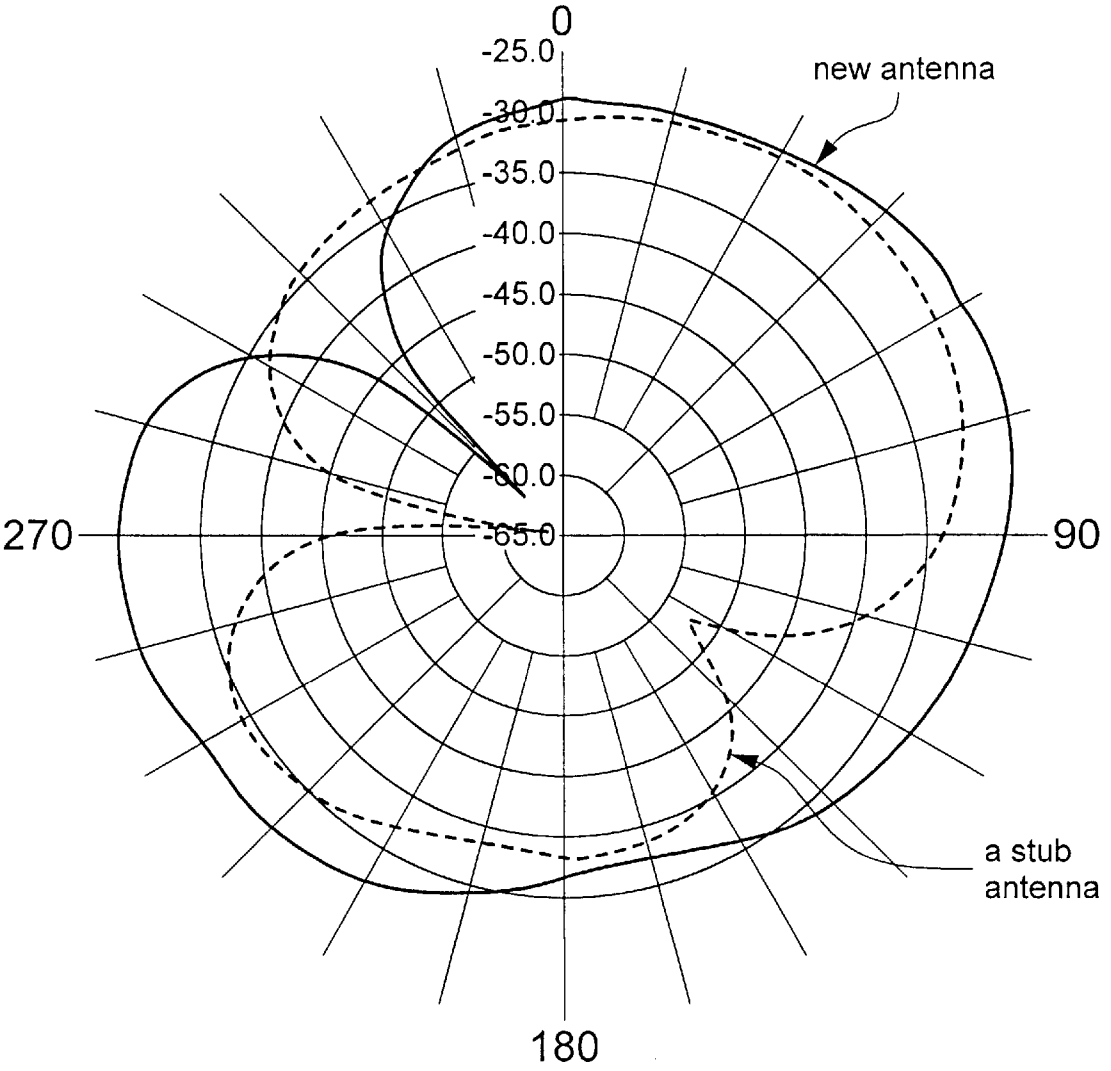
FIG. 8 illustrates the radiation patterns at 900 MHz for a stub antenna and the multi-band swivel antenna according to the present invention.

In FIG. 6, a graphical representation of the performance of the multi-band swivel antenna according to the present invention is provided. For this example, the antenna was placed in a fully deployed position and the low and high bands were specified as GSM and DCS bands. The diagram indicates a first peak corresponding to the GSM frequency band and a second peak corresponding to the DCS frequency band. It will be appreciated that a suitable antenna according to the present invention can be designed to operate in two or more bands corresponding to GSM, DCS, PCS, or other frequency bands. The results of radiation pattern tests for Applicants' inventive multi-band swivel antenna compared to a conventional stub antenna are set forth in FIGS. 7 and 8 for frequencies of 1800 MHz and 900 MHz, respectively. As is evident from FIGS. 7 and 8, the radiation pattern for the multi-band swivel antenna is much more uniform than that of the stub antenna for both 1800 MHz and 900 MHz. Many variants and combinations of the techniques taught above may be devised by a person skilled in the art without departing from the spirit or scope of the invention as described by the following claims.

What is claimed is:

1. A communication device for use in a radio communication system, said device comprising:

a microphone opening for allowing the communication device to receive auditory information from a user;

a speaker opening for allowing the communication device to transmit auditory information to said user;

a keypad; and a multiple band, swivel antenna comprising:

a small multi-band resonant antenna element;

a sleeve comprising a first arm and a second arm tuned to first and second frequency bands, respectively; and a coaxial feeding cable for connecting said small multi-band resonant antenna element and said sleeve to a chassis of said communication device;

wherein a length of said coaxial feeding cable is selected so as to increase antenna efficiency of said communication device.

2. The communication device of claim 1 further comprising ferrite coating attached to said coaxial feeding cable for reducing current flow to said chassis.

3. The communication device of claim 1 wherein said first frequency band and said second frequency band are different.

4. The communication device of claim 3 wherein said first frequency band is lower than said second frequency band.

5. The communication device of claim 1 wherein said first arm is longer than said second arm.

6. The communication device of claim 5 wherein said first frequency band is lower than said second frequency band.

7. The communication device of claim 5 wherein an end of said first arm is formed as one of a meandering, loop, and helical shape.

8. The communication device of claim 1 wherein said first arm and said second arm are positioned on opposite sides of said coaxial feeding cable.

9. An antenna for a radio communication device, said antenna comprising:

a radiating portion comprising:

a small multi-band resonant antenna element; and a multi-band sleeve comprising a first arm and a second arm tuned to different frequency bands; and a coaxial feeding cable for connecting said radiating portion to a chassis of said radio communication device.

10. The antenna of claim 9 wherein said antenna is a swivel-type antenna.

11. The antenna of claim 10 wherein said antenna is in a paging mode when placed in a stowed position.

12. The antenna of claim 10 wherein said antenna is in a talking mode when placed in a deployed position.

13. The antenna of claim 9 further comprising a ferrite coating attached to said coaxial feeding cable for reducing current flow to said chassis.

14. The antenna of claim 9 wherein said first arm is resonant at frequencies in a lower band and said second arm is resonant at frequencies in a higher band.

15. The antenna of claim 14 wherein said lower band is a GSM band and said higher band is one of a DCS, PCS, GPS, WCDMA and ISM band.

16. The antenna of claim 14 wherein said lower band is one of a GSM, AMPS, DAMPS, DCS, PCS, and WCDMA band and said higher band is an ISM band.

17. The antenna of claim 9 wherein said first arm and said second arm are located on opposite sides of said coaxial feeding cable.

18. The antenna of claim 9 wherein said first arm is longer than said second arm.

19. The antenna of claim 18 wherein said first frequency band is lower than said second frequency band.

20. An antenna for a radio communication device comprising:

a radiating portion comprising:

a small multi-band radiating antenna element; and a multi-band sleeve comprising a first arm and a second arm tuned to different frequencies.

21. The antenna of claim 20 further comprising a coaxial cable for connecting said radiating portion to a chassis of said radio communication device.

22. The antenna of claim 20 wherein said first arm is resonant at frequencies in a lower band and said second arm is resonant at frequencies in a higher band.

23. The antenna of claim 22 wherein said lower band is a GSM band and said higher band is one of a DCS, PCS, GPS, WCDMA and ISM band.

24. The antenna of claim 22 wherein said lower band is one of a GSM, AMPS, DAMPS, DCS, PCS, and WCDMA band and said higher band is an ISM band.

25. The antenna of claim 22 wherein said first arm is longer than said second arm.

26. The antenna of claim 20 wherein said first arm is longer than said second arm.

27. The antenna of claim 26 wherein said first arm is resonant at a first frequency which is lower than the frequency at which the second arm is resonant.

28. The antenna of claim 26 wherein an end of said first arm is formed as one of a helical, loop, and meandering shape.

29. The antenna of claim 21 wherein said first arm and said second arm are located on opposite sides of said coaxial cable.

30. A radiating portion of an antenna comprising:

a sleeve comprising a first arm and a second arm tuned to a first and a second frequency band, respectively;

wherein said first frequency band is lower than said second frequency band.

31. The radiating portion of claim 30 wherein said first arm is longer than said second arm.

32. The radiating portion of claim 30 further comprising a small multi-band radiating antenna element.

33. The radiating portion of claim 30 wherein said first frequency band is a GSM band and said second frequency band is one of a DCS, PCS, GPS, WCDMA, and ISM band.

34. The radiating portion of claim 30 wherein said first frequency band is one of a GSM, AMPS, DAMPS, DCS, PCS, and WCDMA band and said second frequency band is an ISM band.

35. The radiating portion of claim 31 wherein an end of said first arm is formed as one a helical, loop, and meandering shape.

* * * * *